US005842461A

United States Patent [19]

Azuma

[11] Patent Number: 5,842,461

[45] Date of Patent: Dec. 1, 1998

[54] DICING MACHINE

[75] Inventor: Masayuki Azuma, Mitaka, Japan

[73] Assignee: Tokyo Seimitsu Co., Ltd., Tokyo, Japan

[21] Appl. No.: 908,941

[22] Filed: Aug. 8, 1997

[30] Foreign Application Priority Data

Aug. 13, 1996 [JP] Japan ..... 8-213896

[51] Int. Cl.[6] ..... B28D 1/04

[52] U.S. Cl. ..... 125/13.01; 125/14; 125/20; 451/194; 83/425.2

[58] Field of Search ..... 125/13.01, 13.03, 125/14, 15, 20; 83/425.2, 471.3; 451/190, 194, 195, 197, 200, 201

[56] References Cited

U.S. PATENT DOCUMENTS

| | | | |
|---|---|---|---|
| 4,407,262 | 10/1983 | Wirz et al. | 125/13.01 |
| 4,416,312 | 11/1983 | Ostberg | 83/425.2 |
| 4,688,540 | 8/1987 | Ono | 125/13.01 |
| 5,176,060 | 1/1993 | Thornton | 83/471.3 |

FOREIGN PATENT DOCUMENTS

| | | |
|---|---|---|
| 0 186 201 | 7/1986 | European Pat. Off. . |
| 59-156753 | 10/1984 | Japan . |
| 62-53804 | 3/1987 | Japan . |
| 8-25209 | 1/1996 | Japan . |
| 1 761 516 | 9/1992 | U.S.S.R. . |

OTHER PUBLICATIONS

Patent Abstracts of Japan, vol. 096, No. 005, 30 May 1996 & JP 08 025209 A (Disco Abrasive Syst Ltd), 30 Jan. 1996, * Abstract *.

Patent Abstracts of Japan, vol. 016, No. 416, (M–1304), 2 Sep. 1992 7 JP 04 141396 A (Disco Abrasive Syst Ltd), 14 May 1992, *Abstract *.

Patent Abstracts of Japan, vol. 015, No. 171 (M–1108), 30 Apr. 1991 & JP 03 036003 A (Seiko Epson Corp), 15 Feb. 1991, * Abstract *.

Patent Abstracts of Japan, vol. 014, No. 447 (M–1029), 25 Sep. 1990 & JP 02 178005 A (NEC Corp), 11 Jul. 1990, * Abstract *.

*Primary Examiner*—Eileen P. Morgan
*Attorney, Agent, or Firm*—Sixbey, Friedman, Leedom & Ferguson; David S. Safran

[57] ABSTRACT

A dicing machine of the present invention is provided with two spindles, which are arranged parallel to one another in the direction of the Y-axis and face one another. A workpiece is moved toward the spindles in the direction of the X-axis, and two blades fitted to the two spindles cut the workpiece. The two spindles are movable in the direction of the Y-axis, so that the two blades can be arranged at a desired interval. One of the spindles is movable in the direction of the X-axis so that the two blades can be arranged on the same street. Hence, desired two streets or one street can be simultaneously cut with the two blades.

16 Claims, 9 Drawing Sheets

DICING MACHINE

BACKGROUND OF THE INVENTION

1. Field of the Invention

The present invention relates generally to a dicing machine, and more particularly to a dicing machine which is provided with two spindles.

2. Description of Related Art

A dicing machine cuts a workpiece such as a semiconductor wafer by rotating a blade, which is fitted to an end of a spindle. Japanese Patent Provisional Publication Nos. 62-53804 and 8-25209, Japanese Utility Model Provisional Publication No. 59-156753, etc. have disclosed dual-type dicing machines, which are provided with two spindles. The dual-type dicing machine simultaneously cuts the workpiece with two blades, which are respectively fitted to the two spindles.

The dicing machines disclosed by Japanese Patent Provisional Publication Nos. 62-53804 and 8-25209 are constructed in such a manner that two spindles are arranged parallel to one another and face one direction and each spindle moves straight in the axial direction (hereinafter referred to as a parallel arrangement type). According to the dicing machine of the parallel arrangement type, the two blades can simultaneously cut the same street (cutting line). In addition, by moving each spindle in the axial direction to adjust the relative positions of the two blades, two streets can be cut at the same time.

The dicing machine disclosed by Japanese Utility Model Provisional Publication No. 59-156753 is constructed in such a manner that two spindles are coaxially arranged to face one another and both spindles move straight in the axial direction (hereinafter referred to as an opposite arrangement type). According to the dicing machine of the opposite arrangement type, two streets can be simultaneously cut with two blades which are arranged opposite to one another.

In the case of the parallel arrangement type dicing machine, a workpiece transfer distance (a stroke in the back and forth movement of the workpiece) should be increased by an interval between the two spindles. On the other hand, in the case of the opposite arrangement type dicing machine, two streets can be cut with the same stroke as in the case when there is only one spindle. For this reason, the dicing machine of the opposite arrangement type has a higher work efficiency. In the case of the opposite arrangement type dicing machine, however, the two blades cannot be arranged on a straight line and cannot cut the same street at the same time. Moreover, if the opposite two blades approach one another, other members should be prevented from contacting one another, and hence the interval between the two blades cannot be set at less than a proper distance.

SUMMARY OF THE INVENTION

The present invention has been developed in view of the above-described circumstances, and has as its object the provision of a dicing machine which is capable of arranging two blades, which are fitted to two opposite spindles, at a desired interval, arranging the two blades on the straight line, and cutting two desired streets or one street with the two blades at the same time.

In order to achieve the above-stated object, a dicing machine of the present invention comprises: two blades for cutting a workpiece; two spindles for holding and rotating the blades, the spindles being arranged parallel to one another in a first direction and being capable of moving relatively to one another in the first direction and a second direction perpendicular to the first direction so that the blades can be arranged opposite to one another at a desired interval and can be arranged on a straight line in the second direction; and a moving means for moving the spindles and the workpiece relatively to one another in the second direction so as to cut the workpiece with the blades.

Moreover, to achieve the above-stated object, another dicing machine of the present invention comprises: two blades for cutting a workpiece; two spindles for holding and rotating the blades, the spindles being arranged parallel to one another in a first direction and being capable of moving relatively to one another in a second direction tilting at a predetermined angle from the first direction to a third direction perpendicular to the first direction so that the blades can have a desired interval in the first direction and can be arranged on a straight line in the third direction; and a moving means for moving the spindles and the workpiece relatively to one another in the third direction so as to cut the workpiece with the blades.

According to the present invention, the two spindles, of which axial direction corresponds to the Y-axis, can face one another and can be arranged at a desired interval. Thereby, the two blades can be arranged in a straight line in the X-axis, and the two blades are capable of efficiently cutting the desired two or one street at the same time.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
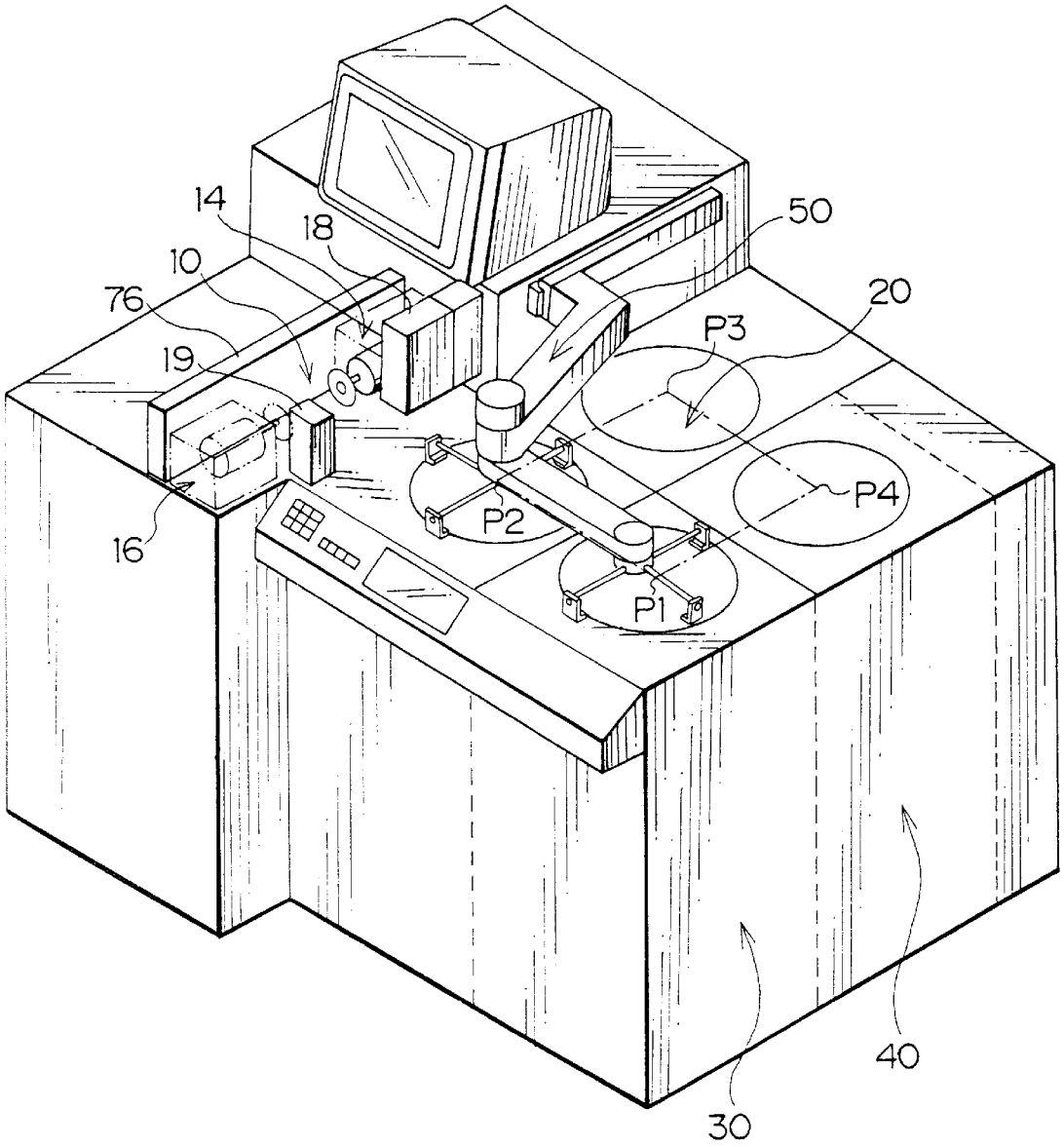
FIG. 1 is a perspective view illustrating the dicing machine according to the present invention.
Figure 2:
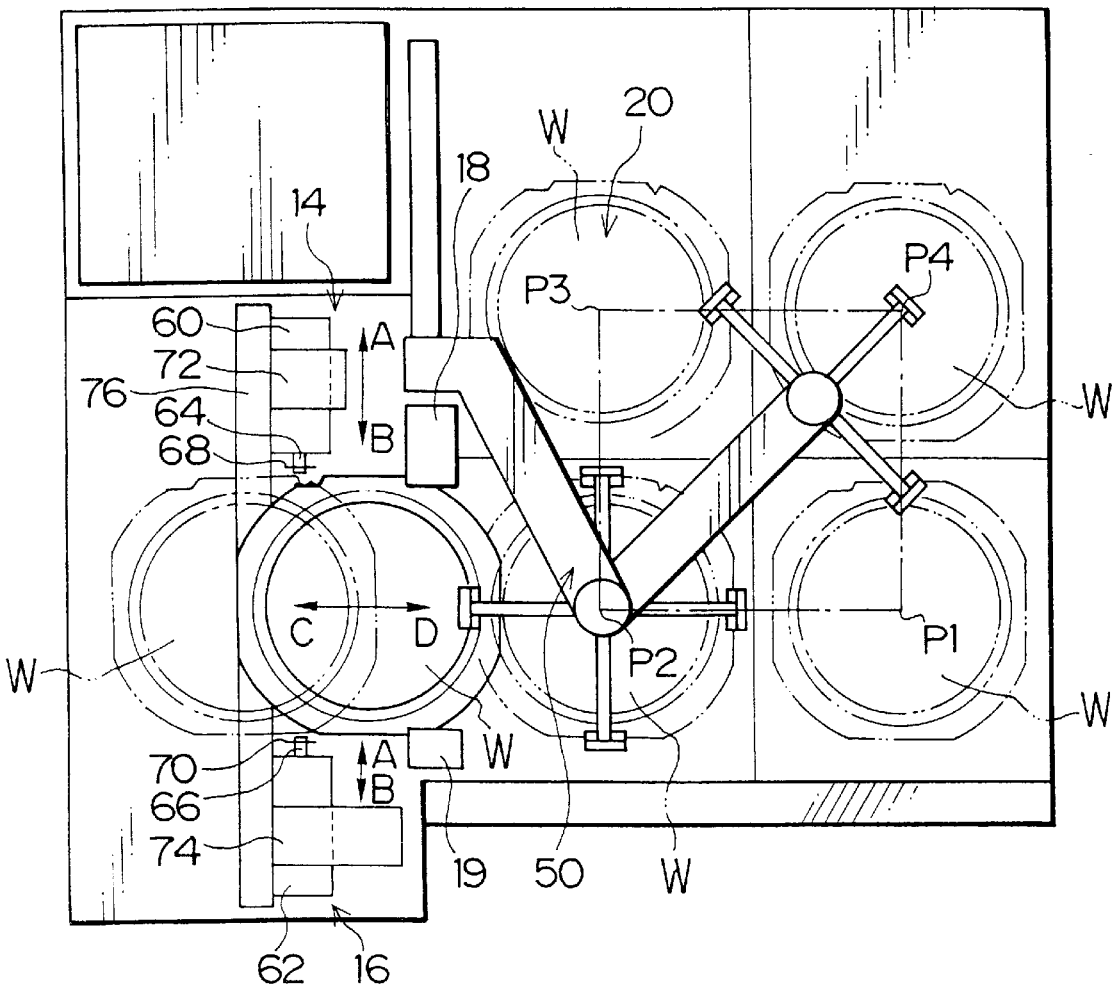
FIG. 2 is a plan view illustrating the dicing machine according to the present invention.

FIG. 1 is a perspective view illustrating the dicing machine according to the present invention, and FIG. 2 is a plan view thereof. The dicing machine is comprised mainly of a cutting part 10 for cutting a workpiece (a wafer) W in directions perpendicular to one another to thereby cut the wafer W in a grid pattern; a cleansing part 20 for cleansing the cut wafer; a cassette part 30 for holding the wafer before and after processing; an elevator part 40 for pulling out the wafer W before processing from a desired position in the cassette part 30 to prealign the wafer on a stage and for replacing the processed wafer, which is set on the stage, at a desired position in the cassette part 30; and a transfer unit 50 for transferring the wafer W through the above-mentioned steps.

An explanation will hereunder be given about the operation of the dicing machine. The wafers W before processing, which are stored in the cassette part 30, are successively pulled out to the elevator part 40, and the pulled-out wafers are set at a position P4 in FIG. 2. Then, the transfer unit 50 places the wafer W, which was set at P4, on a cutting table at P2 of the cutting part 10 via a preload stage at P1. When the wafer W is placed on the cutting table, fine alignment parts 18, 19 recognize a pattern on the wafer W by its image, and rotate the cutting table in accordance with the recognized pattern. The fine alignment parts 18, 19 also move two pieces of cutting equipment 14, 16, which are arranged to face one another, in directions of arrows A and B in FIG. 2 to thereby finely align the cutting equipment 14, 16 with the pattern on the wafer W. Then, the wafer W is moved with the cutting table in directions of arrows C and D in FIG. 2, while the cutting equipment 14, 16 cuts the wafer W.

After the cutting part 10 cuts the wafer W, the wafer W is returned to P2, and then the transfer unit 50 transfers the wafer W on a spin table of the cleansing part 20 at the position P3. The cut wafer W is cleansed with water and is blown dry there.

After the wafer W is dried, the transfer unit 50 transfers the wafer W to a position P4 in FIG. 2, and the elevator part 40 putts the wafer W back in the cassette part 30.

Figure 3:
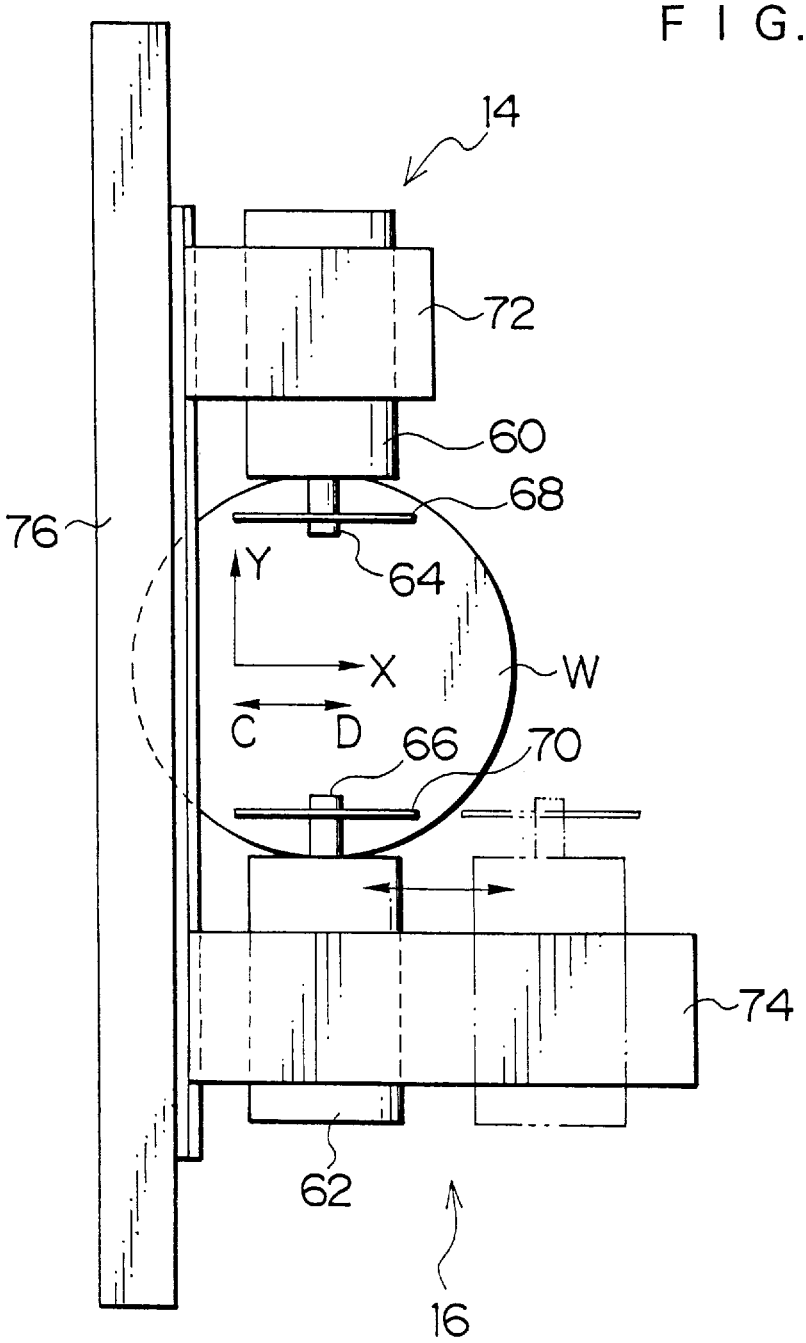
FIG. 3 is a plan view illustrating an embodiment for a cutting part of the dicing machine.

Next, a detailed explanation will be given about the cutting part 10 of the dicing machine. FIG. 3 is a plan view of the cutting part 10. As shown in FIG. 3, the two pieces of cutting equipment 14, 16 of the cutting part 10 are provided with spindles 64, 66, which are rotated by motors 60, 62, and blades 68, 70, which are fitted to the ends of the spindles 64, 66. These motors 60, 62, the spindles 64, 66 and the blades 68, 70 move in the direction of the Y-axis in connection with Y-axis moving members 72, 74.

The Y-axis moving members 72, 74 are movably supported by a guide rail part 76, which is provided in the direction of the Y-axis perpendicular to a direction of the X-axis in FIG. 3 (a moving direction of the wafer W: directions of the arrows C and D). The Y-axis moving members 72, 74 are respectively moved along the guide rail part 76 in the direction of the Y-axis by motors (not shown), and thereby the positions of the blades 68, 70 are adjusted.

Figure 4:
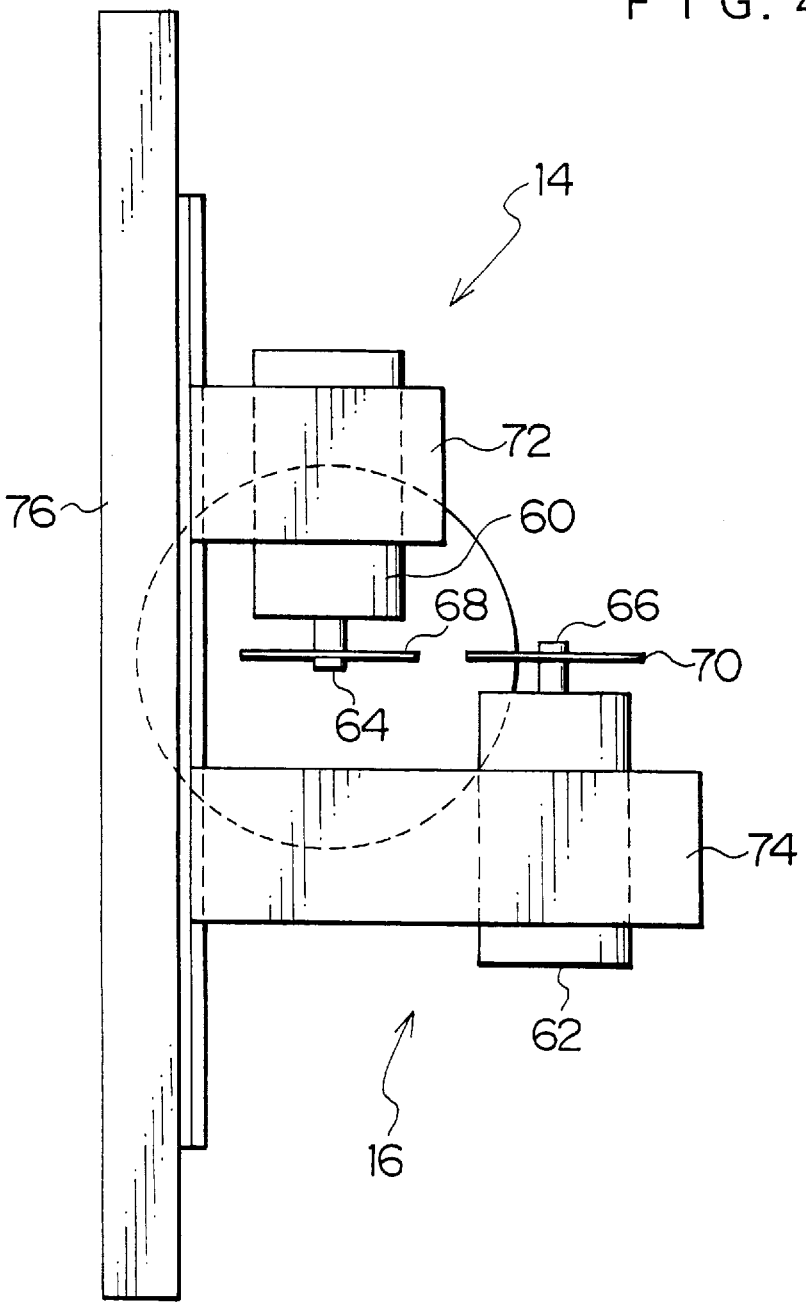
FIG. 4 is a plan view illustrating the state that two blades of the cutting part in FIG. 3 are arranged in a straight line.

The cutting equipment 16 is movable in the direction of the X-axis as described later, and hence the cutting equipment 16 can avoid the cutting equipment 14 in the direction of the X-axis. Consequently, the blades 68, 70 can be arranged on the same street as shown in FIG. 4 in such a state that the two pieces of cutting equipment 14, 16 do not contact one another.

Figure 5:
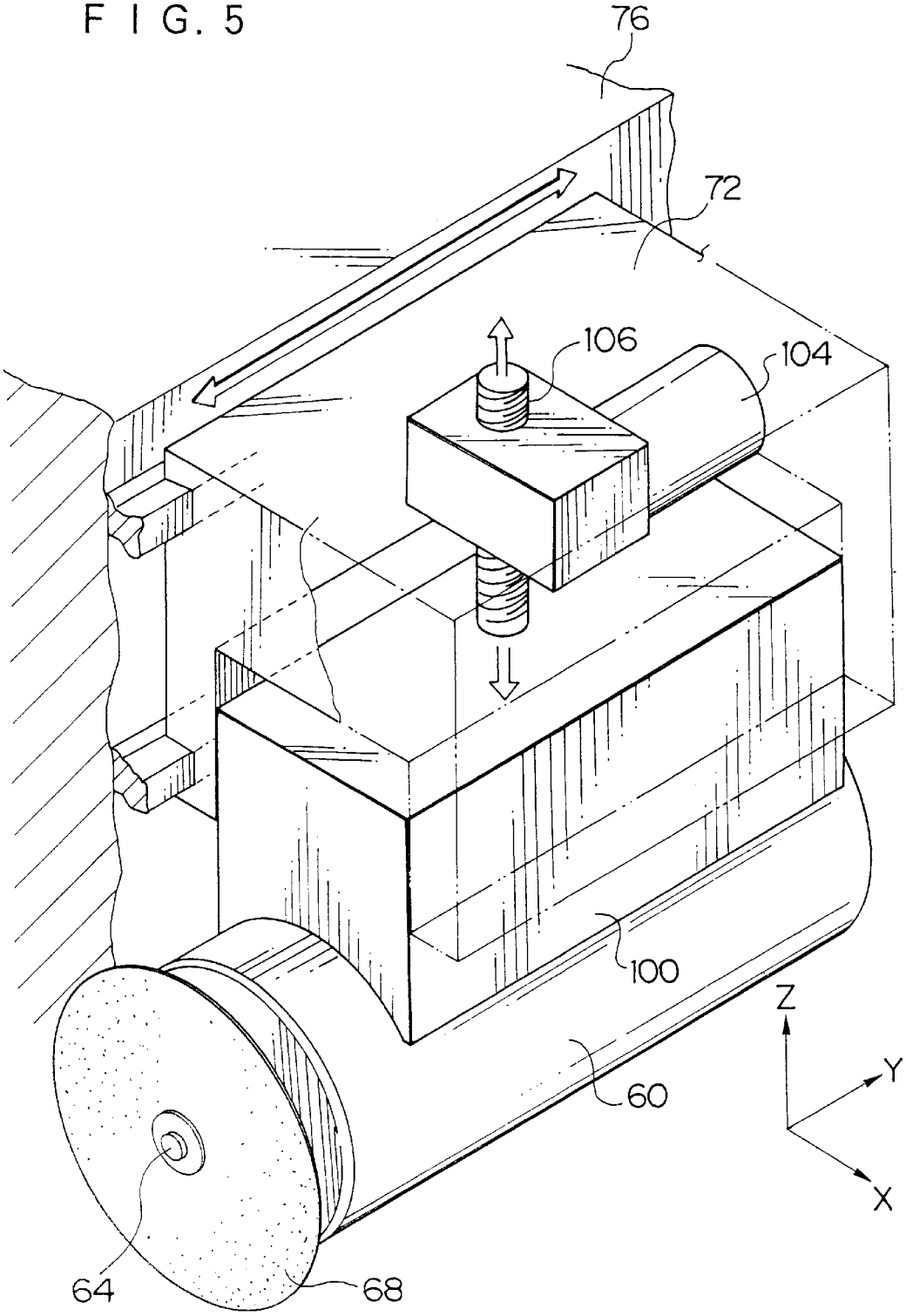
FIG. 5 is an enlarged perspective view illustrating the construction of cutting equipment in the dicing machine in FIG. 3.

Next, an explanation will be given about the construction of the cutting equipment 14, 16. FIG. 5 is an enlarged perspective view of the cutting equipment 14. As shown in FIG. 5, the motor 60 which rotates the spindle 64 is mounted on a motor supporting member 100 which is supported by the Y-axis moving member 72 in such a manner as to be movable up and down (hereinafter referred to as the direction of the Z-axis). A motor 104 fixed to the Y-axis moving member 72 moves up and down (in the direction of the Z-axis) the motor supporting member 100 via a screw 106.

Figure 6:
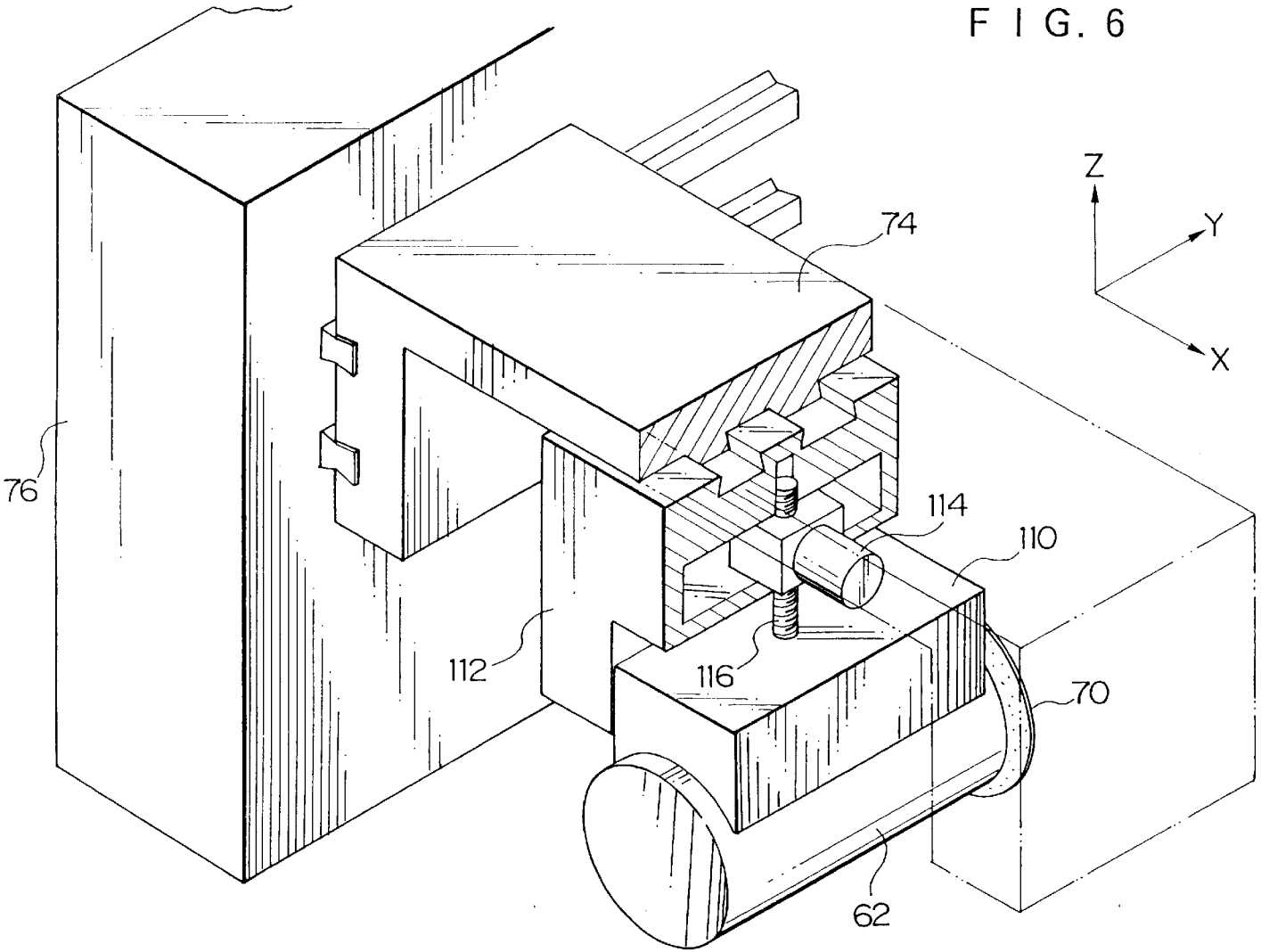
FIG. 6 is an enlarged perspective view illustrating the construction of cutting equipment in the dicing machine in FIG. 3.

FIG. 6 is an enlarged perspective view of the cutting equipment 16. As shown in FIG. 6, the motor 62 which rotates the spindle 66 is mounted on a motor supporting member 110 which is supported by an X-axis moving member 112 in such a manner as to be movable in the direction of the Z-axis. A motor 114 fixed to the X-axis moving member 112 moves the motor supporting member 110 via a screw 116 in the direction of the Z-axis. The X-axis moving member 112 is supported by the Y-axis moving member 74 in such a manner as to be movable in the direction of the X-axis, and the X-axis moving member 112 is moved in the direction of the X-axis by a motor (not shown). Hence, the blade 70 of the cutting equipment 16 can move in the directions of the X, Y and Z-axes.

According to the cutting part 10 which is constructed in the above-mentioned manner, in order to simultaneously cut two streets on the wafer W which are more than a predetermined distance away from one another, the spindle 66 of the cutting equipment 16 is arranged coaxial with the spindle 64 of the cutting equipment 14. In order to simultaneously cut two streets which are less than the predetermined distance away from one another, or one street, the cutting equipment 16 is moved in the direction of the X-axis, and thereby the blade 70 of the cutting equipment 16 can avoid the blade 68 of the cutting equipment 14.

Figure 7:
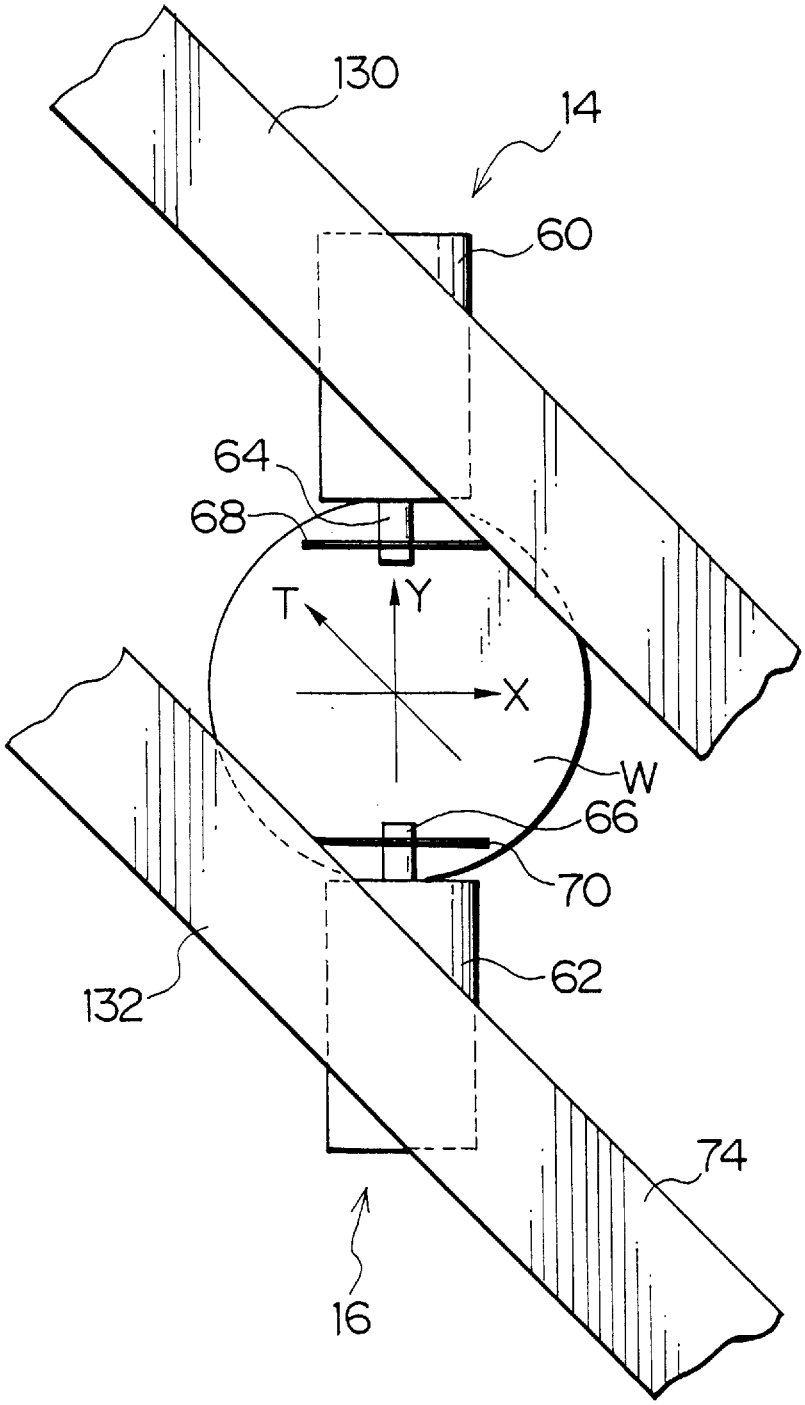
FIG. 7 is a plan view illustrating another embodiment for the cutting part of the dicing machine.

FIG. 7 is a plan view illustrating another embodiment for the cutting part 10. As shown in FIG. 7, guide rails 130, 132, which guide the two pieces of cutting equipment 14, 16 respectively, are beam-shaped and arranged parallel to one another in a direction (hereinafter referred to as a direction of a T-axis) which tilts from the direction of the Y-axis at a predetermined angle to the direction of the X-axis. The two pieces of cutting equipment 14, 16 are hung from the guide rails 130, 132 and move along the guide rails 130, 132 to be arranged at desired positions.

Figure 8:
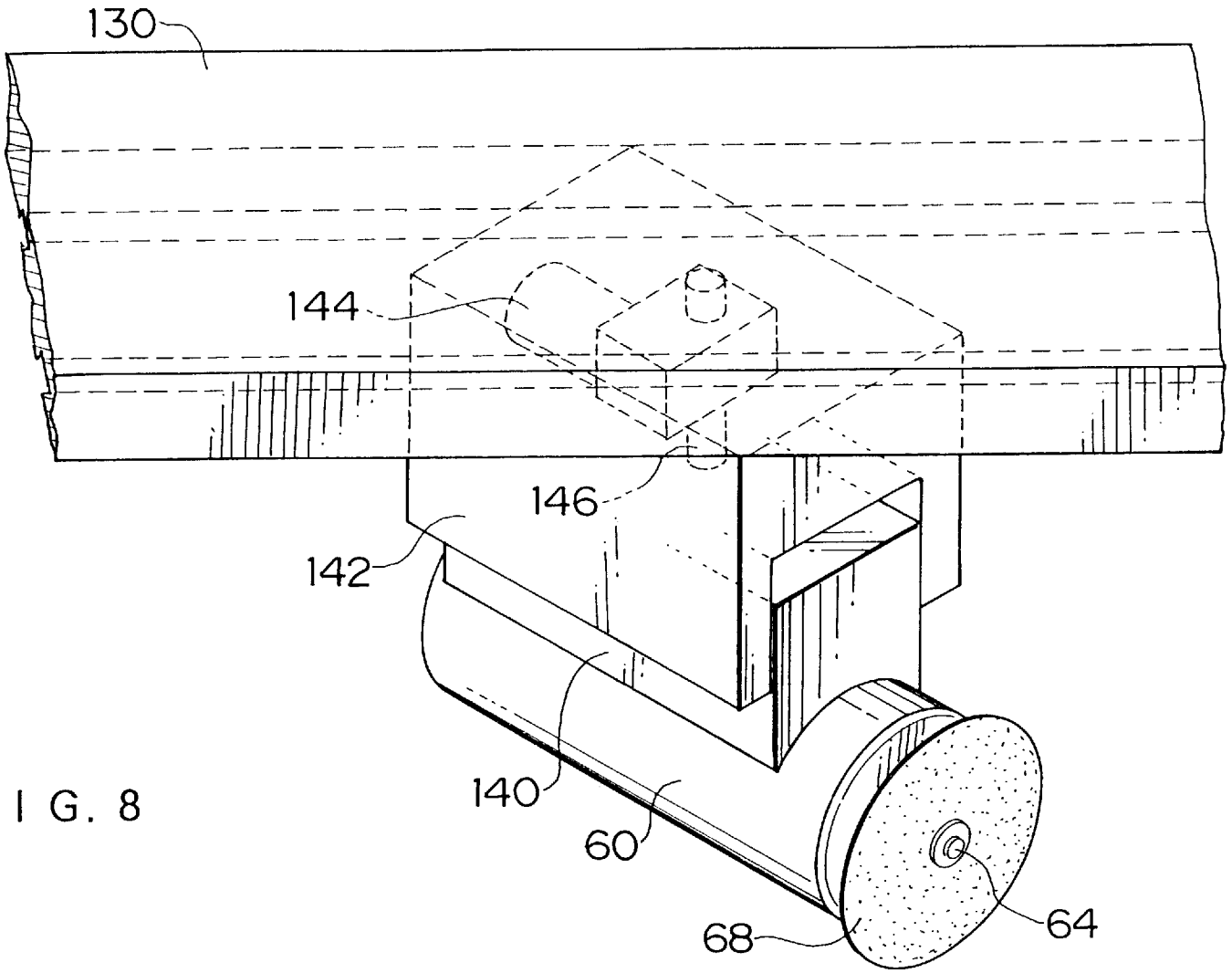
FIG. 8 is an enlarged perspective view illustrating the construction of cutting equipment in the dicing machine in FIG. 7.

FIG. 8 is an enlarged perspective view of the cutting equipment 14. As shown in FIG. 8, the motor 60 which rotates the spindle 64 is mounted on a motor supporting member 140 which is supported by a T-axis moving member 142 in such a manner as to be movable in the direction of the Z-axis. A motor 144 fixed to the T-axis moving member 142 moves the motor supporting member 140 via a screw 146 in the direction of the Z-axis. A motor (not shown) moves the T-axis moving member 142 along the guide rail 130 in the direction of the T-axis.

The cutting equipment 16 is constructed in the same manner as the cutting equipment 14.

According to the dicing machine, the two pieces of cutting equipment 14, 16 are moved in the direction of the T-axis to arrange two blades 66, 68 on two desired streets or one street.

In these embodiments, the two pieces of cutting equipment 14, 16 are moved in the direction of the Y-axis or T-axis by the moving mechanism which uses the guide rail. The present invention, however, should not be restricted to this. For example, cantilever structure may be used as shown in FIG. 9.

Figure 9:
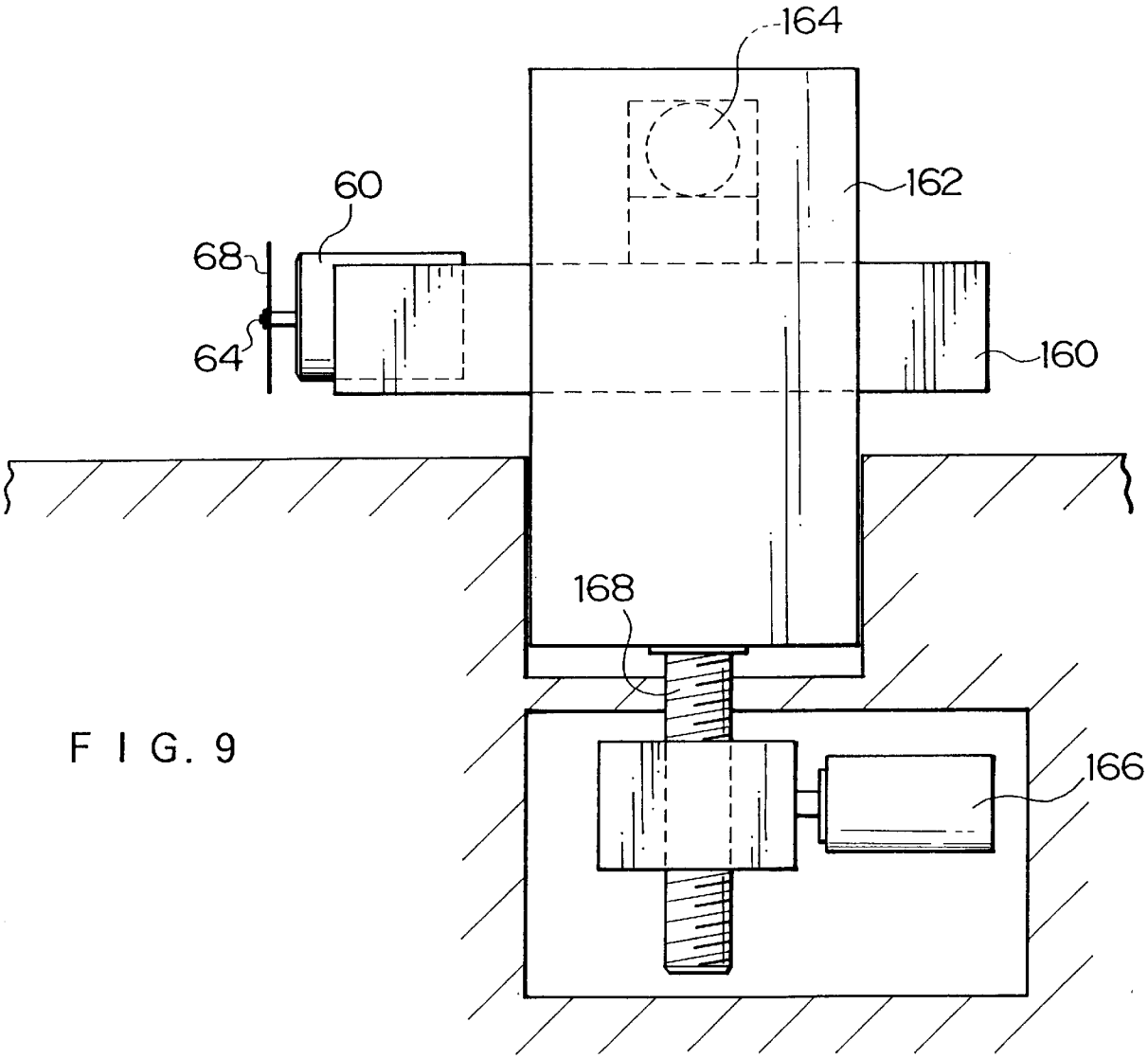
FIG. 9 is a view illustrating the construction of another embodiment for a moving mechanism of the cutting equipment.

According to the moving mechanism in FIG. 9, the motor 60 which rotates the spindle 64 is mounted on a motor supporting member 160 which is supported by a supporting member 162 in such a manner as to be movable in the direction of the Y-axis or T-axis. The motor supporting member 160 is moved in the direction of the Y-axis or T-axis by a motor 164 fixed to the supporting member 162. The supporting member 162 is moved in the direction of the Z-axis via a screw 168 by a motor 166 which is fixed to a base.

The dicing machine of the present invention may be applied to not only the above-stated equipment for cutting a (semiconductor) wafer but also any equipment which uses blades.

According to the dicing machine of the present invention, two spindles which are parallel to the Y-axis and face one another can be arranged at a desired interval, and the two blades can be arranged on a straight line in the direction of the X-axis. The desired two streets or one street can be efficiently cut with the two blades at the same time. Hence, the blades of the same type are mounted in the two spindles to cut the two streets at the same time. When the two spindles face one another, two streets can be cut with the same stroke as in the case when there is only one spindle, so that the cutting time can be reduced. In addition, two kinds of blades can be respectively fitted to the two spindles so as to cut the same street, so that the groove machining, etc. can be efficiently performed.

It should be understood, however, that there is no intention to limit the invention to the specific forms disclosed, but on the contrary, the invention is to cover all modifications, alternate constructions and equivalents falling within the spirit and scope of the invention as expressed in the appended claims.

I claim:

1. A dicing machine comprising:

two blades for cutting a workpiece;

two spindles for holding and rotating said blades, said spindles being arranged parallel to one another in a first direction and being capable of moving relatively to one another in the first direction and a second direction perpendicular to the first direction so that said blades can be arranged opposite to one another at a desired interval and can be arranged on a straight line in the second direction; and moving means for moving said spindles and the workpiece relatively to one another in the second direction so as to cut said workpiece with said blades.

2. The dicing machine as defined in claim 1, wherein said two blades cut two streets on the workpiece.

3. The dicing machine as defined in claim 1, wherein said two blades are arranged in the straight line to cut one street on the workpiece at the same time.

4. The dicing machine as defined in claim 1, wherein said two blades are of the same type.

5. The dicing machine as defined in claim 1, wherein said two blades are of different types.

6. The dicing machine as defined in claim 1, wherein said blade cuts a groove on the workpiece.

7. The dicing machine as defined in claim 1, wherein the workpiece is a semiconductor wafer.

8. A dicing machine comprising:

two blades for cutting a workpiece;

two spindles for holding and rotating said blades, said spindles being arranged parallel to one another in a first direction and being capable of moving relatively to one another in a second direction tilting at a predetermined angle from the first direction to a third direction perpendicular to the first direction so that said blades can have a desired interval in the first direction and can be arranged on a straight line in the third direction; and moving means for moving said spindles and the workpiece relatively to one another in the third direction so as to cut said workpiece with said blades.

9. The dicing machine as defined in claim 8, wherein said two blades cut two streets on the workpiece.

10. The dicing machine as defined in claim 8, wherein said two blades are arranged in the straight line to cut one street on the workpiece at the same time.

11. The dicing machine as defined in claim 8, wherein said two blades are of the same type.

12. The dicing machine as defined in claim 8, wherein said two blades are of different types.

13. The dicing machine as defined in claim 8, wherein said blade cuts a groove on the workpiece.

14. The dicing machine as defined in claim 8, wherein the workpiece is a semiconductor wafer.

15. The dicing machine as defined in claim 8, further comprising two guide rails for guiding said two spindles, said two guide rails being arranged parallel to one another in the second direction.

16. The dicing machine as defined in claim 15, wherein said guide rails are beam-shaped and said spindles are hung from said guide rails.

* * * * *